United States Patent [19]

Sangster

[11] 4,306,634

[45] Dec. 22, 1981

[54] LIFT ASSEMBLY

[76] Inventor: George G. Sangster, 1719 E. Claremont, Phoenix, Ariz. 85016

[21] Appl. No.: 64,787

[22] Filed: Aug. 8, 1979

[51] Int. Cl.[3] ..... B66B 9/20

[52] U.S. Cl. ..... 187/9 R; 414/921

[58] Field of Search ..... 187/9 R, 9 E, 24, 25; 414/921, 545, 541; 254/7 R, 98, 13

[56] References Cited

U.S. PATENT DOCUMENTS

| | | | |
|---|---|---|---|
| 47,761 | 5/1865 | Willard | 187/25 |
| 2,884,225 | 4/1959 | Ford | 254/98 |
| 3,172,551 | 3/1965 | Wolfe | 414/921 |
| 4,026,387 | 5/1977 | Abreu | 187/9 R |
| 4,096,955 | 6/1978 | Dake | 414/921 |
| 4,133,437 | 1/1979 | Gates | 187/24 |

*Primary Examiner*—David A. Scherbel
*Assistant Examiner*—Kenneth Noland
*Attorney, Agent, or Firm*—Richard R. Mybeck

[57] ABSTRACT

A lift assembly for raising and lowering people and things which is especially useful for providing safe and convenient ingress and egress to and from recreational vehicles for disabled persons such as those who are confined to wheel chairs, the device having a pivotable articulated platform receiving selective vertical movement by way of a special linkage between the platform and a threaded driven shaft which in turn responds to a reversible electric motor which is actuatable by remote signal device which may be held by the operator thereof.

6 Claims, 6 Drawing Figures

LIFT ASSEMBLY

INTRODUCTION

This invention relates generally to a lift assembly for use in conjunction with the handling of loads and more particularly to a lift assembly to enable a person who is physically disabled to raise and lower himself/herself between the ground and the entrance to a vehicle or other raised elevation.

BACKGROUND OF THE INVENTION

A lift assembly of the type herein contemplated when associated with a vehicle, such as a van or mobile home, is usually mounted in a rear or side doorway thereof. It commonly comprises a platform which can be positioned on the exterior of the vehicle and level with the vehicle floor. The user wheels himself from the interior of the vehicle onto the platform and then actuates means to lower the platform to the ground level. The reverse sequence is followed when the user desires to return to the vehicle.

In the design of such lift assemblies, a number of characteristics are sought to be attained. For example, it is desirable to provide an assembly which is as compact as possible to permit the assembly to be permanently installed to either the interior or the exterior of the vehicle without unduly usurping interior space where space is a premium or creating an irregular external bulge which inhibits both the movement of the vehicle and the movement of other vehicles relative thereto.

Prior art assemblies frequently used hydraulic systems to raise and lower the platform but these systems were unacceptable because they were bulky and the hydraulic cylinders required an anchoring super structure as well as hydraulic reservoirs, pumps and the like.

Another prior art assembly employed a hydraulic platform which was strung on cables and pulleys and which folded into the vehicle (See: Fowler, U.S. Pat. Nos. 3,613,917 and 3,710,962) but again suffered from the area required by the assembly adjacent the vehicle in order to operate.

Still another hydraulic system was taught by Cassady in U.S. Pat. No. 3,893,576. Cassady suffered however from the use of a rotating platform which also required an extremely wide opening in the vehicle to function.

Other attempts were made to overcome certain of these defects and included a platform linked to a vehicle and extending from an upstanding stored position to a horizontal loading position level with the vehicle floor which was taught by Pohl in U.S. Pat. No. 3,984,014. A cable-and-drum combination was utilized to move the plaform between various horizontal positions.

Abreu, U.S. Pat. No. 4,026,387, attempted to solve the problem of storing the platform by folding it beneath the floor board of the trailer or vehicle when it was not in use but this suffered from the problem that the arrangement substantially reduced road clearance for the vehicle to which it was attached and was readily susceptible to damage and breakage while the vehicle was moving.

The most recent attempt to meet the need for an efficient and compact lifting assembly was disclosed by Collins et al in U.S. Pat. No. 4,113,121 in which the lift platform was further provided with a pin release to separate the lift platform from the lift frame when a failure of the primary power source occurs so the passenger could be freed.

While each of the foregoing prior art devices achieved some of the desired goals, each left serious deficiencies unfulfilled so that a great need still exists for a lift assembly which utilizes minimal space while having sufficient power to raise a load up to and lower such load from a vehicle doorway relative to the ground and is capable of operation by a disabled person to achieve untraumatic ingress to and egress from a vehicle.

Accordingly it is a primary object of the present invention to provide a new and improved lift assembly for use in conjunction with a vehicle which overcomes the deficiencies of the prior art devices.

It is another object of the present invention to provide a new and improved lift assembly in which a pivotable articulated platform receives vertical movement in response to the selective rotation of a threaded drive shaft within an integral collar member strategically linked to said platform.

These and still further objects as shall hereinafter appear are fulfilled in a remarkably unexpected fashion by the present invention as shall be readily discerned from a careful consideration of the following detailed description of an exemplary embodiment thereof, especially when considered in conjunction with the accompanying drawing which is hereinafter described.

SUMMARY OF THE INVENTION

The present invention provides means for raising and lowering a platform mounted adjacent the opening of a recreational vehicle to enable a disabled person to obtain quick and convenient ingress and egress with the recreational vehicle.

While the preferred embodiment of the present invention will be described and illustrated as a device to enhance the ability of a disabled person to achieve ingress and egress to a motor vehicle, it is apparent and is intended that the structure will also provide valued assistance in the loading and unloading of cargo relative to other vehicles and warehouse shelving; in the positioning of large articles or sheets of material for high construction such as ceilings and the like and otherwise positioning articles off of the ground for ease of transport. Likewise, the recreational vehicle characterized herein may also be a truck cab, a motor bus, a van, an airplane, a home or other like structure, whether mobile or stationary, which requires persons or things to be moved from a first to a second location when those locations are at different vertical elevations.

The lift assembly of the present invention is simple in design, rugged in construction and is strategically mountable relative to a vehicle door to enable quick and easy access to and from the interior thereof. A unique articulated platform is pivotable about multiple pivots into and out of the vehicle and includes a member which is engageable by a unique linkage with a selectively powered and reversible drive shaft to obtain vertical movement of said platform relative to said shaft and transport a passenger or other cargo disposed on said platform to and from said vehicle interior.

Thus, an assembly is provided which achieves all of the desired objectives of transporting a passenger or things between ground level and the interior of a vehicle with maximum power efficiency while requiring signficantly less area to do so than was heretofore obtainable with the prior art devices.

The advantages and detailed objects of the present invention will become further evident from a careful consideration of the following detailed description, especially when read in conjunction with the accompanying drawings which illustrate a preferred embodiment of the invention and in which like parts bear like indicia throughout the several views.

THE DRAWINGS

DESCRIPTION OF A PREFERRED EMBODIMENT

Figure 1:
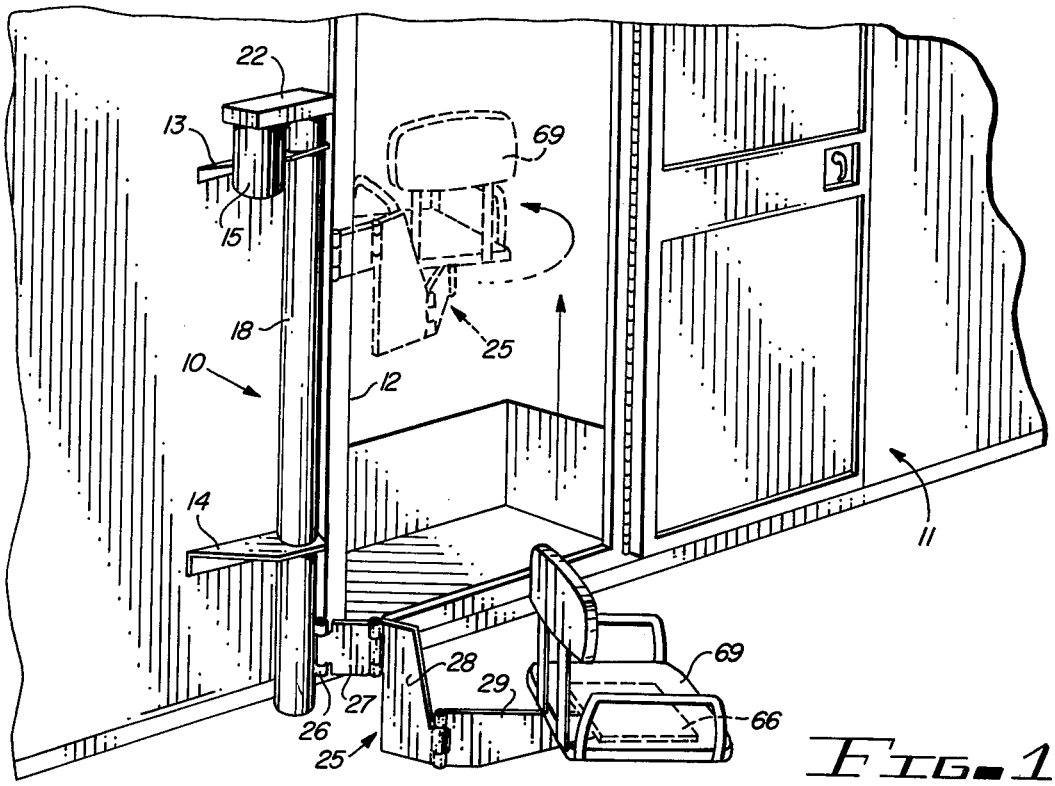
FIG. 1 is a perspective view of a lift assembly embodying the present invention operatively associated with a recreational vehicle.
Figure 2:
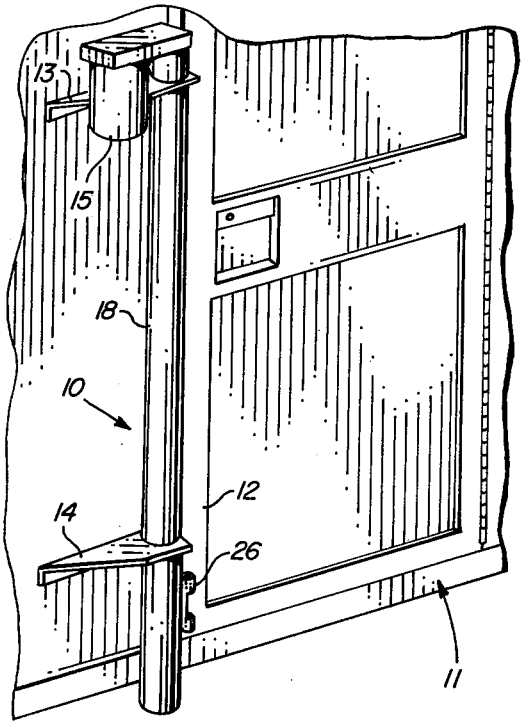
FIG. 2 is a perspective view of the assembly of FIG. 1 in travelling position.
Figure 4:
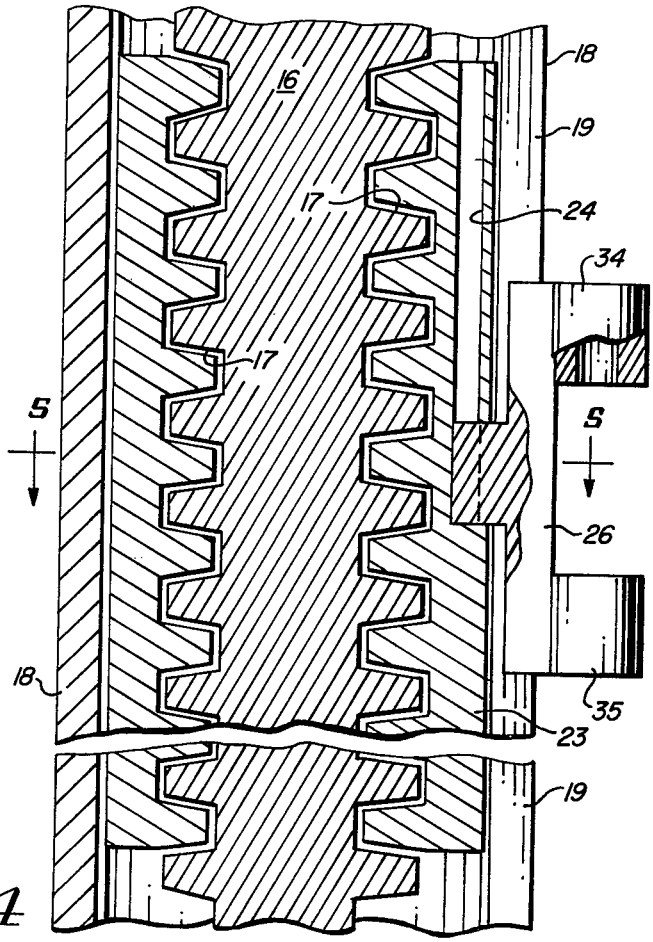
FIG. 4 is a cross-sectional showing of the lift assembly taken along line 4—4 of FIG. 3.

Referring to FIG. 1, the numeral 10 is used to generally designate a lift assembly embodying the present invention. The device 10 is mounted to a recreational vehicle 11 adjacent the doorway 12 thereof within suitable upper support means 13 and lower support means 14. A reversible electric motor 15 is disposed adjacent upper support means 13 and is operatively connected to drive shaft 16 which depends downwardly therefrom through upper and lower support means 13, 14, respectively. Drive shaft 16 is provided with an acme thread 17 along its axis and is contained within shaft housing 18 which has axially extending slot 19 disposed therein for a purpose to be hereinafter described.

Shaft 16 is mounted for selective rotation in upper thrust bearing means 20 and lower thrust bearing means 21 and has a suitable gear reduction box 22 operatively interposed between the upper end thereof and motor 15 to provide the desired torque for shaft 16 for reasons which will hereinafter become apparent.

A tubular brass collar 23, having an axial dimension of at least the distance between the upper surface of annular portion 34 and the lower surface of annular portion 35, circumscribes drive shaft 16 in threaded engagement with acme thread 17 while abutting in a riding relationship therewith the inner surface of housing 18 to prevent any lateral movement of collar 23 relative thereto.

Collar 23 is provided with a T-shaped slot or key-way 24 extending axially thereof down the upper portion thereof intermediate of thread 17 and housing 18 to provide a secure linkage for articulated platform 25 in a manner which will be hereinafter described.

Articulated platform 25 comprises, in one embodiment thereof, four discrete sections, namely, a first section 26, a second section 27, a third section 28 and a fourth section 29.

Suitable limit switches 30, 30 are provided adjacent the upper end and lower end of housing 18 to disengage the motor 15 from shaft 16 and prevent the overrun of the housing.

Reverting back to articulated platform 25 which extends radially from drive shaft 16, let us consider the construction of the sections.

First section 26, as shown in FIGS. 2, 3, 4 and 5, consists of a plate-like part 31 defining a "T" in section having a cross-bar portion 32 and a stem portion 33 extending outwardly and generally normal from cross bar 32, a first and second annular portion 34, 35, each integrally formed at the base of stem portion 33 in spaced relationship to each other and each circumscribing an opening 36, 37, respectively, the function of which shall be hereinafter described.

Figure 3:
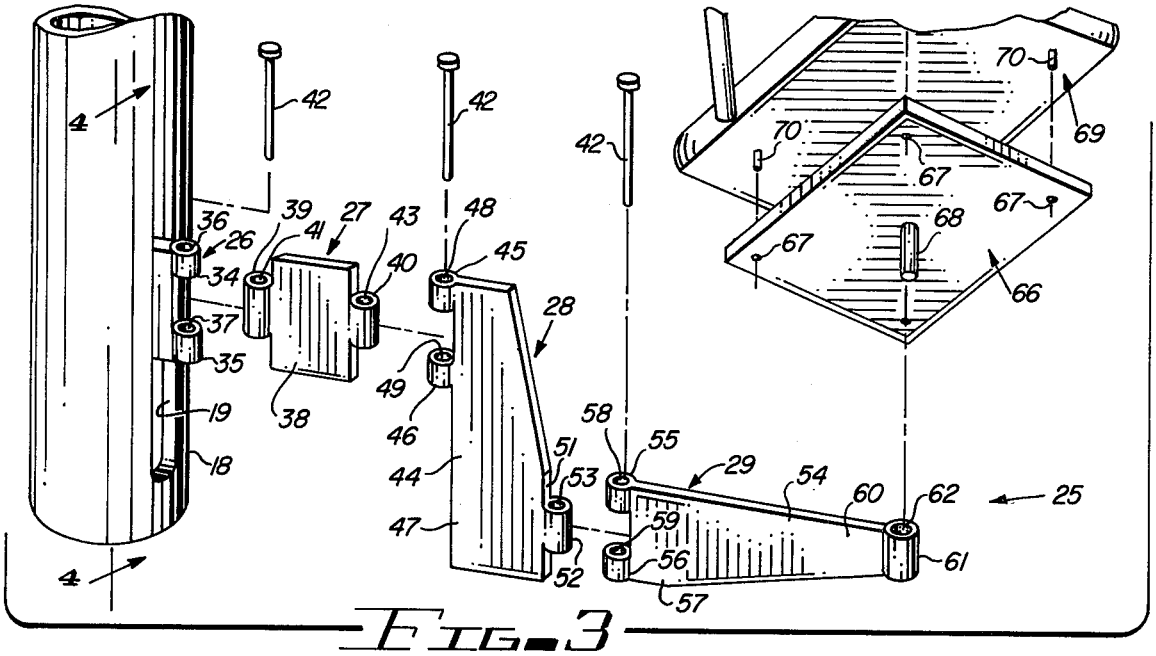
FIG. 3 is a perspective exploded view of a lift assembly embodying the present invention.
Figure 5:
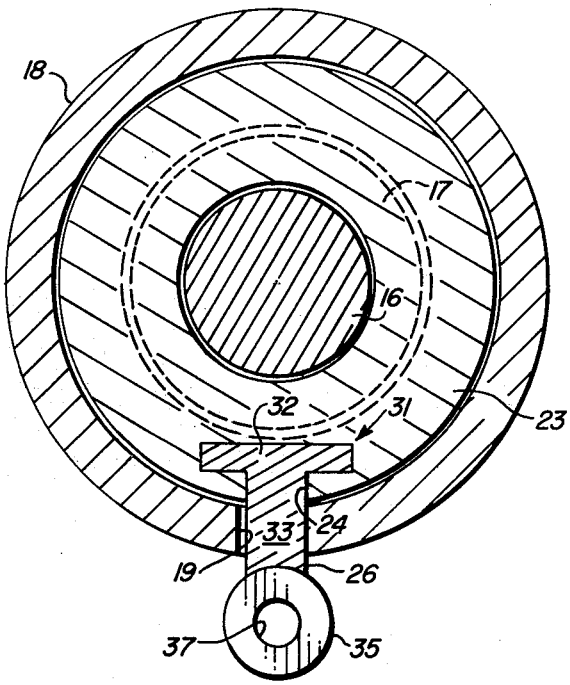
FIG. 5 is a cross-sectional showing of a drive shaft and linkage arrangement embodying the present invention taken along line 5—5 of FIG. 4.

Second section 27, as shown in FIGS. 1 and 3, comprises a plate-like body portion 38 having an annular portion 39 disposed at one end thereof and a second annular portion 40 disposed at the other end thereof. Tubular portion 39 surrounds opening 41 defined therethrough and is dimensioned for insertion in the space between annular portions 34, 35 so that opening 41 is alignable with openings 36, 37 to receive therethrough a suitable restraining means such as connection pin 42 to define a pivotal hinge thereabout. Tubular portion 40 likewise surrounds an opening 43 defined therethrough for a purpose to be explained in the following.

Third section 28, as shown in FIGS. 1 and 3, comprises a body portion 44 having a pair of spaced axially aligned annular members 45, 46 disposed upon the wide edge 47 thereof respectively defining openings 48, 49 therethrough. Members 45, 46 are positioned to receive member 40 therebetween so that openings 39, 48 and 49 are axially aligned to receive a suitable restraining means, such as connecting pin 42, therein to define a second pivotal hinge thereabout.

Remote of edge 47 in section 28 is a narrower edge 51 having an annular member 52 disposed thereupon and integrally formed therewith. Member 52 circumscribes an opening 53 and functions in a manner to be described hereinafter.

Fourth section 29 comprises a plate-like generally tapered body portion 54 having an upper annulus 55 and a lower annulus 56 disposed adjacent the wider end 57 of body portion 54, each defining opening 58, 59 respectively. Annular members 55, 56 are disposed in spaced axially aligned relationship to each other and adapted to receive tubular member 52 therebetween so that opening 53 defined thereby is axially alignable with openings 58, 59 to receive therethrough a suitable restraining means such as connection pin 42 to define a pivotal hinge thereabout.

Adjacent the narrower end 60 of tapered body 54, is disposed annular member 61 which defines opening 62 therethrough for a purpose to be explained.

A base plate 66 which may be rectangular, as shown in FIG. 3, or circular or of other suitable shape, having a plurality of openings 67 defined therethrough and a centrally disposed pivot pin 68 depending therefrom is supported upon and carried by platform 25 by the insertion of pin 68 in opening 62 for pivotal action relative thereto.

A suitable supporting means such as chair seat 69 is attached to base plate 66 in any suitable fashion such, for example, as is obtained by disposing a plurality of depending pins 70 from seat 69 in such a fashion that each pin 70 passes into a corresponding one of holes 67 to prevent the lateral slippage of seat 69 relative to plate 66.

When assembled for operation, articulated platform 25 is mounted to permit stem portion 33 to extend through and ride in slot 19 of shaft housing 18 so that the T-shaped portion 31 of section 26 is passed down into slot 24 defined in collar 23 and held in the fixed position by the coaction of gravity thereupon in conjunction with the interior of the slot.

Section 27 is then attached thereto by aligning openings 36, 37 and 40 and passing pivot pin 42 therethrough.

Where, as in the setting chosen to exemplify the invention, it is desired to raise an object such as a disabled person from ground level, third section 28 will be constructed as shown in FIG. 3 wherein the linkage points are off set and achieve a vertical set off equal to the horizontal plane of the hinges thus formed. Accordingly, openings 48 and 49 are aligned with opening 43 to receive a pivot pin 42 therethrough to define a pivot hinge between the second and third sections, 27, 28, respectively. Similarly, opening 53 will be aligned with openings 58, 59 to receive pivot pin 42 therethrough to define a pivot hinge between third section 28 and fourth section 29.

The articulated platform 25 is completed by mounting seat 69 to base plate 66 by inserting pins 70 through holes 67 and thereafter inserting pin 68 into opening 62.

Figure 6:
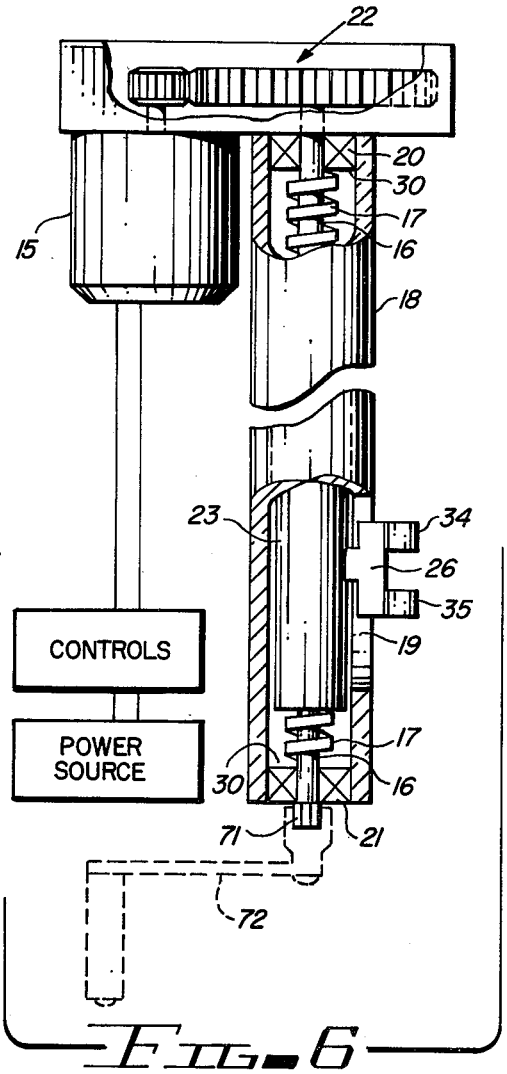
FIG. 6 is a diagramatic showing of the motor, drive shaft and associated reduction gear of the present invention.

The entire platform 25 sub-assembly is movable in a vertical direction in response to the preselected direction of rotation of drive shaft 16 as it coacts with collar 23 in housing 18. Rotational movement of shaft 16 is attained by actuating the controls (shown schematically in FIG. 6) which are interposed between a suitable power source (FIG. 6) and motor 15.

The rotational movement of shaft 16, at a speed regulated by the gear reduction box 22, is thereafter translated into vertical movement of platform 25 by the rotation of shaft 16 and the coaction of thread 17 in collar 23 and the integral linkage of first section 26 (and hence the entire sub-assembly) to collar 23.

When an application of this invention requires a different vertical set off than that described, third section 28 can be modified accordingly or, if desired, inverted without departing from the spirit of the invention.

OPERATION

To raise and lower people and things by lift device 10, the passenger or cargo being placed for support by base plate 66 and in turn, the entire platform 25, control means are activated to operate motor 15 which in turn transmits motion through gear reduction box 22 and causes drive shaft 16 to rotate. As shaft 16 rotates, platform 22 is caused to be raised or lowered (depending upon the direction of rotation selected for the motor) by the action of acme thread 17 upon the collar 23 and in turn upon T-shaped portion 31 of section 26. Section 27 is pivotal relative to section 26 about pin 42 while section 28 is pivotal relative to section 27 about its pin 42 and section 29 is pivotal relative to section 28 about its pin 42.

The pivotal action of the various sections to its adjacent sections enables the cargo carried upon plate 66 (such as a person seated in seat 69 mounted to said base plate 66) to be readily turned into or withdrawn from doorway 12 and when in a position clear of the associated vehicle or the like, readily transportable in a vertical direction to the desired location.

The switching means utilized to activate motor 15 may be either remote control or direct control and can be either mounted to the side or disposed with an extension cord for holding by the passenger.

When the lift device 10 is not in use, the articulated platform 25 is readily separated into its several increments by pulling pins 42 from their respective seats and removing pin 68 from opening 62 and placing the several components in suitable storage such as within the vehicle.

Should electric power, provided by a storage battery or a conventional 110 volt hookup fail, a mechanical crank 72 may be utilized by engaging hexagonal end 71 of shaft 16 therewith to manually rotate shaft 16 in the desired direction to complete the vertical movement of platform 25.

From the foregoing, it becomes apparent that a new and useful lift assembly has been herein described and illustrated which fulfills all of the aforesaid objectives in a remarkably unexpected fashion, it being understood that such modifications, alterations and adaptations as may readily occur to an artisan having the ordinary skills to which this invention pertains are intended within the spirit of the present invention which is limited only by the scope of the claims appended hereto.

Accordingly what I claim is:

1. A lift assembly comprising: a power source; a motor responsive to said power source; a rotatable drive shaft driveable by said motor in a clockwise or a counterclockwise direction; switching means for selectively activating and deactivating said motor; a collar having an upper and a lower portion circumscribing said drive shaft and movable relative thereto in a vertical direction in response to the rotation thereof, said collar having a T-shaped slot defined axially therein in said upper portion thereof; a first hinge section having a T-shaped portion extending therefrom for complimentary engagement within said T-shaped slot and a second portion extending oppositely from said T-shaped portion, first and second annular portions integrally formed on said second portion in spaced relationship to each other, each annular portion defining an opening therewithin; an articulated platform comprising a plurality of discrete sections, each of said sections being pivotally connectable on at least one edge thereof to another of said sections, said platform at one end thereof having an annular portion disposed thereupon defining an opening therewith, said annular portion of said platform being interposable between said first and said second annular portions of said second portion of said T-shaped portion to axially align the several openings; and a removable restraining means inserted within said axially aligned openings to secure said platform to said first hinge section in pivotal relationship thereto whereupon said platform is movable in concert with said collar.

2. An assembly according to claim 1 in which one of said plurality of said discrete section of said platform remote from said collar comprises means for receiving and securing a base plate thereupon.

3. An assembly according to claim 2 in which said base plate supports a seat member thereupon.

4. An assembly according to claim 1 in which at least one of said sections is off set in the horizontal plane of said platform.

5. An assembly according to claim 1 in which a housing encases said shaft and said collar, said housing having a vertical slot extending axially thereof and coacting with said T-shaped portion to prevent the rotation of said collar relative to said housing irrespective of the rotation of said shaft.

6. An assembly according to claim 5 in which said articulated platform is connected to said collar through said slot.

* * * * *